US005882081A

United States Patent [19]

Earl, Jr.

[11] Patent Number: 5,882,081

[45] Date of Patent: Mar. 16, 1999

[54] KNEELER

[76] Inventor: Lionel F. Earl, Jr., 361 Pratt Cir., Montgomery, Ala. 36115

[21] Appl. No.: 934,690

[22] Filed: Sep. 22, 1997

Related U.S. Application Data

[63] Continuation of Ser. No. 675,544, Jul. 3, 1996, abandoned, which is a continuation-in-part of Ser. No. 184,372, Jan. 21, 1994, Pat. No. 5,577,800.

[51] Int. Cl.[6] ..... A47C 9/00; A47C 16/04

[52] U.S. Cl. ..... 297/423.11; 280/132.6; 297/338; 297/195.11

[58] Field of Search ..... 297/195.11, 338, 297/423.11, 423.12, 423.1, 423.16; 280/7.14, 7.17, 32.6

[56] References Cited

U.S. PATENT DOCUMENTS

| | | | |
|---|---|---|---|
| 1,408,253 | 2/1922 | Blank | 297/423.11 X |
| 2,318,059 | 5/1943 | Cooper | 280/32.6 X |
| 2,480,406 | 8/1949 | Forney | 297/423.11 X |
| 2,750,198 | 6/1956 | Moore et al. | 280/7.14 |
| 3,863,978 | 2/1975 | Gilliage, Jr. | 297/423.11 X |
| 4,772,071 | 9/1988 | Richards | 297/423.12 |

FOREIGN PATENT DOCUMENTS

| | | | |
|---|---|---|---|
| 449588 | 7/1948 | Canada | 297/423.12 |

*Primary Examiner*—Peter R. Brown
*Attorney, Agent, or Firm*—Peter Loffler

[57] ABSTRACT

A kneeler is comprised of a generally rectangular base having a pair of coextensive troughs with optional knee wells located at the end thereof. A pair of runners are removably secured to the bottom of the device. A seat is removably secured and selectively positioned onto the device with the optional usage of height-raising risers. A tray, or similar peripheral device is removably secured and selectively positioned onto the device.

15 Claims, 3 Drawing Sheets

FIG. 4
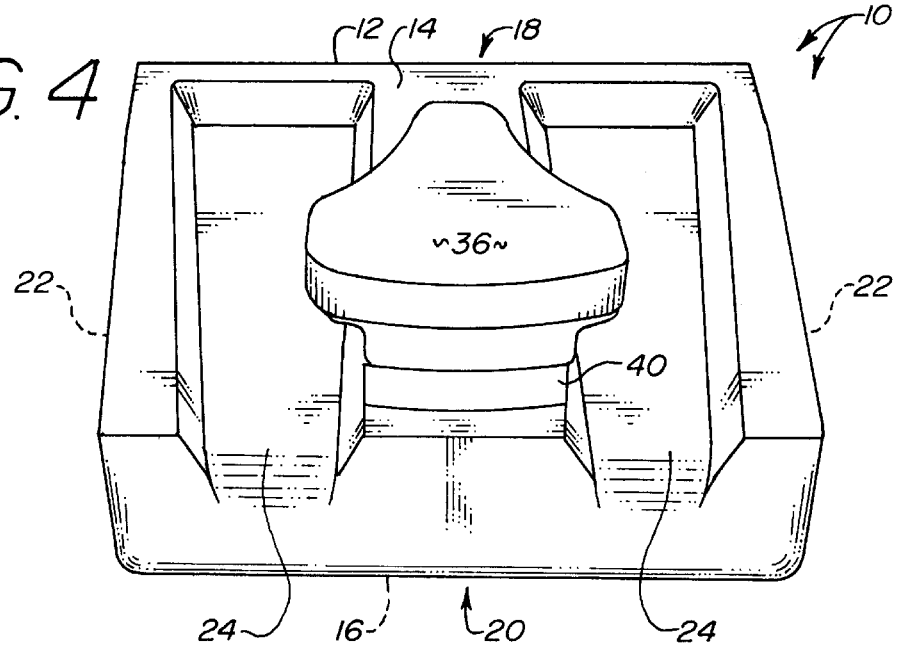
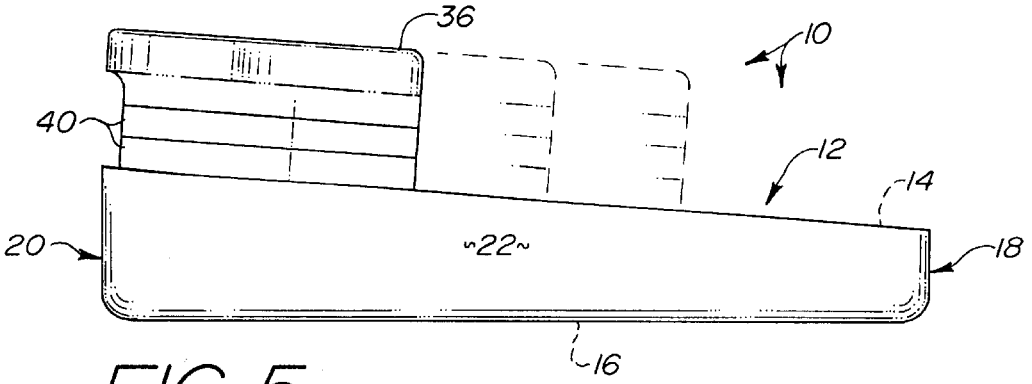
FIG. 5
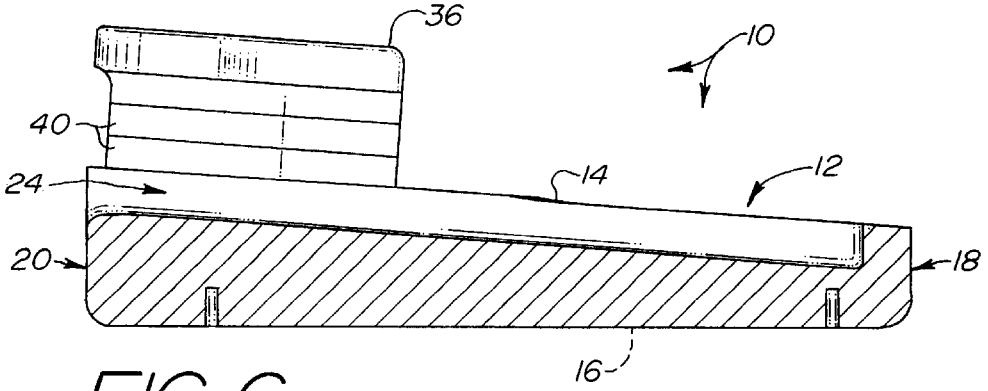
FIG. 6

KNEELER

This application is a continuation of patent application Ser. No. 08/675,544 filed Jul. 3, 1996 now abandoned, which is a continuation-in-part of patent application Ser. No. 08/184,372, filed Jan 21, 1994 now U.S. Pat. No. 5,577,800.

BACKGROUND OF THE INVENTION

1. Field of the Invention

The present invention relates to a device for providing user comfort in a kneeling position.

2. Background of the Prior Art

Working on cars, washing children in a bath tub, and working in the garden are but a few examples of endeavors that require a person to be in a kneeling position, sometimes for extended periods of time. Kneeling, especially prolonged kneeling, can result in pressure buildup and subsequent pain and stiffness in the knees, legs, thighs and back. In extreme situations, medical attention is required. As a result of the discomfort in the knees, legs, thighs and back, individuals will refrain from activities that place pressure and stress onto these areas, resulting in necessary chores being avoided.

Devices have been proposed for assisting individuals whose activities involve kneeling. These devices either cushion the knees or legs, or remove pressure from the knees altogether. Although the devices found in the art working with varying degrees of success, they suffer from one of two major maladies.

First, many a greatly reliving or completely eliminating pressure on the knees, give the user limited mobility and thus limited utility. Second, other devices, although providing a high level of user comfort and mobility, are relatively complex to manufacture and, as a result, are expensive to buy and maintain.

Furthermore, none of these devices give the user the ability to sit while in a kneeling position, thereby reducing or eliminating unwanted stress on the lower body Therefore, there is a need in the art for a device for reliving pressure from an individual's knees, legs, thighs and back whenever the individual is in a kneeling position. Such as device must provide a high degree of user comfort by placing the user's weight onto the buttocks, yet must give the user a high level of mobility and versatility. This device must be of simple and straightforward construction.

SUMMARY OF THE INVENTION

The kneeler of the present invention meets the aforementioned needs in the art. The kneeler provides a device for receiving and cushioning a user's knees and legs whenever the user kneels as well as provides a seat in order to place the user's weight onto the buttocks.

The kneeler is comprised of a generally rectangular body member. A pair of troughs coextend from the back of the body toward the front terminating prior to the front. Optional knee wells are locatable at the ends of the troughs distant the back of the device. A pair of runners are removably securable to the bottom of the body member. A seat is removably securable to the top of the body member and is selectively positionable. The seat, can have optional risers interspaced between it and the body. A tray is removably secured to the top of the body and can be selectively positionable.

The device, which can be constructed as an integral unit of soft resilient material, provides a high level of user comfort without restricting either device or user mobility. The device is of very simple design and can be quickly and easily transported

BRIEF DESCRIPTION OF THE DRAWINGS

FIG. 4 is a back elevation view of the kneeler.

FIG. 5 is a side elevation of the kneeler with the various positions of the seat in outline.

FIG. 6 is a cutaway view of the kneeler.

Similar reference numerals refer to similar parts throughout the several views of the drawings.

DETAILED DESCRIPTION OF THE PREFERRED EMBODIMENT

Figure 1:
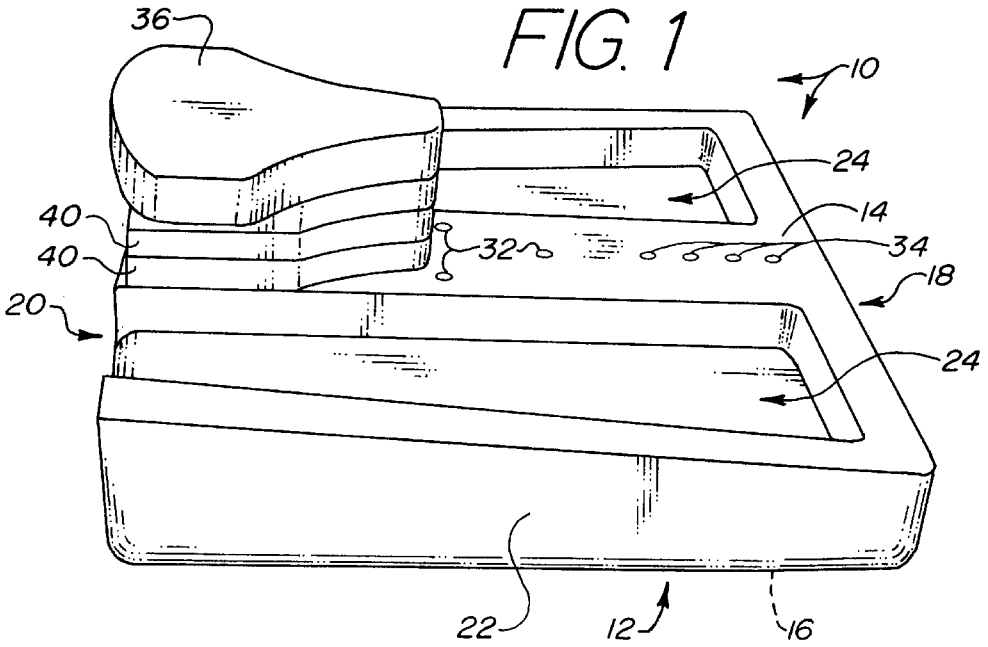
FIG. 1 is an isometric view of the kneeler of the present invention.
Figure 3:
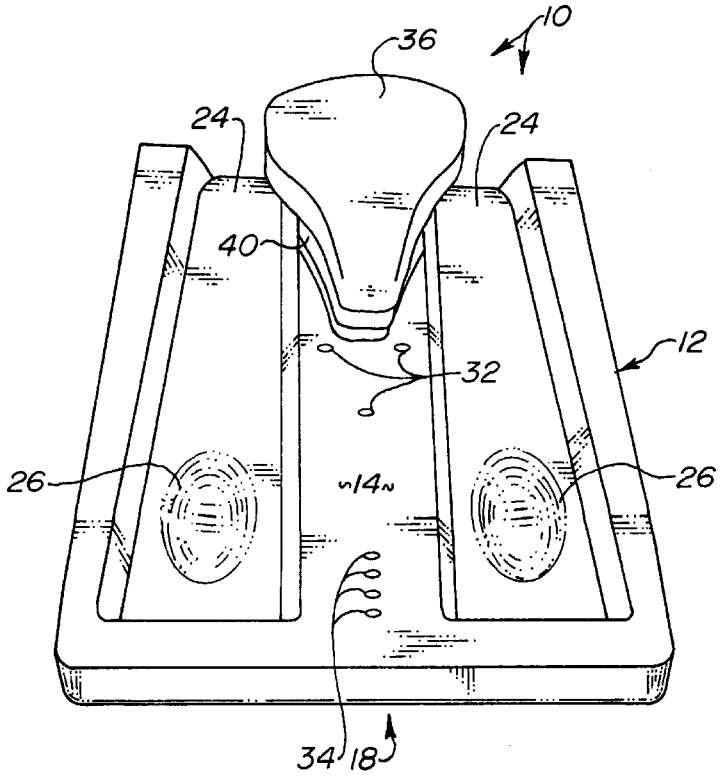
FIG. 3 is a front elevation view of the kneeler.

Referring now to the drawings, it is seen that the kneeler of the present invention, generally denoted by reference numeral 10, is comprised of a generally rectangular base 12, having a top surface 14, a bottom surface 16, and a front 18 and a back 20 joined by coextensive sides 22. The top surface 14 may slope downwardly from the back 20 to the front 18. If desired, the back 20 may be tapered, as seen in FIG. 5.

A pair of coextensive troughs 24 extend from the back 20 and terminate prior to the front 18. If desired, the troughs 24 can slope downwardly from the back 20 toward the front 18. If further desired, a well 26 can be located at the end of each trough 24 distant the back 20.

The troughs 24, the wells 26 if used, and the back 20 are all cushioned for a high level of user comfort. Advantageously, the device 10 can be an integral unit constructed from a relatively soft resilient material such as closed cell foam.

Figure 2:
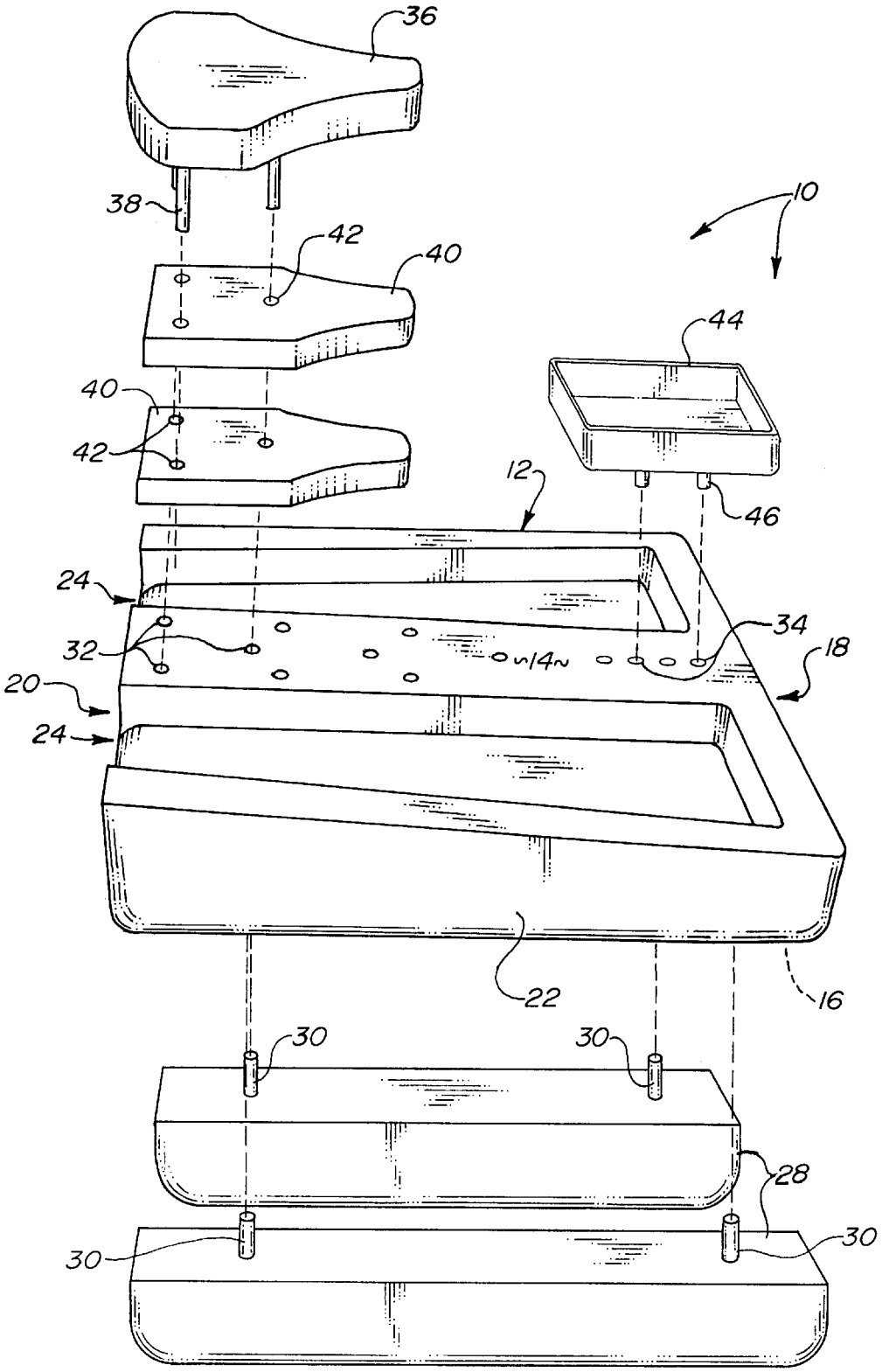
FIG. 2 is an exploded view of the kneeler.

Two sets of apertures (neither set illustrated) are located on the bottom surface 16. As seen in FIG. 2, a pair of runners 28 each have a pair of elongate body members and a pair of upwardly oriented prongs 30. Each pair of prongs 30 is registerable with and receivable within one of the two sets of apertures located on the bottom surface 16, allowing the runners 28 to be removably secured to the kneeler 10, in order to give the kneeler 10 a rise in height as desired.

A plurality of first aperture sets 32 is located on the top surface 14, proximate the back 20 and extending toward the front 18, between the troughs 24, while a plurality of second aperture sets 34 is located on the top surface 14 beyond the first plurality of aperture sets 32.

As seen in FIG. 2, a seat 36 of any appropriate shape and design has a plurality of prongs 38 extending downwardly. The prongs 38 are registerable with and receivable within one of the first aperture sets 32 for removably securing a seat to the kneeler 10. One or more risers 40, in generally similar shape to the shape of the seat, have a plurality of riser apertures 42 located thereon. The prongs 38 of the seat 36 are registerable with and pass through the riser apertures 42 before the seat is secured to the kneeler 10, giving the seat greater elevation. As a plurality of first aperture sets 32 exist, the seat 36 can be selectively placed in one of several positions. A relatively tall person may position the seat 36 relatively close to the back 20 (by registering the prongs 38 of the seat 36 with the first aperture set 32 that is closest to the back 20), while a shorter person would position the seat 36 closer toward the front 18.

A tray 44 has a set of prongs 46 extending downwardly therefrom. The tray prongs 46 are registerable with and receivable within one of the second aperture sets 34 for removably securing the tray 44 (or other peripheral device) to the kneeler 10. As a plurality of second aperture sets 34 exist, the tray 44 can be selectively placed in one of two or more positions.

In order to utilize the kneeler 10 of the present invention, the user secures the runners 28 to the device 10, if desired. If also desired, a seat 36 is secured to the device 10, with one or more risers 40 being utilized, as needed. A tray 44 or other peripheral may be secured to the front of the device 10. The user places his knees in the fronts of the troughs 24 (into the wells 26 if used), with the legs extending the length of the troughs 24. The tops of the user's feet abut the back 20. The user then goes about the chore at hand.

While the invention has been particularly shown and described with reference to an embodiment thereof, it will be appreciated by those skilled in the art that various changes in form and detail may be made without departing from the spirit and scope of the invention.

I claim:

1. A kneeler comprising:

a generally solid rectangular body having a top surface, a bottom surface, and a front and a back joined by a pair of coextensive sides;

a pair of coextensive troughs, disposed within and passing through the top surface, extending from the back and terminating prior to the front;

a seat extending upwardly from the top surface;

at least one first aperture set located on the top surface;

a set of prongs extending downwardly from the seat and registerable with and receivable within the at least one first aperture set; and at least one riser having a second aperture set such that the at least one riser is positioned between the seat and the body and the set of prongs are registerable with and receivable through the second aperture set.

2. The device as in claim 1 further comprising a pair of wells, one well each disposed within an end of each trough distant the back.

3. The device as in claim 2 wherein the troughs and the wells are cushioned.

4. The device as in claim 1 further comprising:

a pair of third aperture sets located on the bottom surface; and a pair of runners, each having a pair of prongs extending upwardly and registerable with and receivable within one of the pair of third aperture sets.

5. The device as in claim 1 further comprising:

at least one fourth aperture set located on the top surface; and a tray, having a set of prongs extending downwardly and registerable with and receivable within the at least one fourth aperture set.

6. The device as in claim 1 wherein the troughs are cushioned.

7. The device as in claim 1 wherein the device is an integral unit constructed from a resilient material.

8. The device as in claim 1 wherein the top surface slopes downwardly from the back to the front.

9. The device as in claim 1 wherein the back of the body is tapered in extending from the top surface to the bottom surface.

10. A kneeler comprising:

a generally solid rectangular body having a top surface, a bottom surface, and a front and a back joined by a pair of coextensive sides;

a pair of coextensive troughs, disposed within and passing through the top surface, extending from the back and terminating prior to the front;

a seat extending upwardly from the top surface;

at least one first aperture set located on the top surface; and a tray, having a set of prongs extending downwardly and registerable with and receivable within the at least one aperture set.

11. The device as in claim 10 further comprising a pair of wells, one well each disposed within an end of each trough distant the back.

12. The device as in claim 10 further comprising:

a pair of second aperture sets located on the bottom surface; and a pair of runners, each having a pair of prongs extending upwardly and registerable with and receivable within one of the pair of second aperture sets.

13. The device as in claim 10 further comprising:

at least one third aperture set located on the top surface; and a set of prongs extending downwardly from the seat and registerable with and receivable within the at least one third aperture set.

14. The device as in claim 13 further comprising at least one riser having a fourth aperture set such that the at least one riser is positioned between the seat and the body and the set of prongs are registerable with and receivable through the fourth aperture set.

15. The device as in claim 10 wherein the back of the body is tapered in extending from the top surface to the bottom surface.

* * * * *